US006276903B1

(12) United States Patent
Popov

(10) Patent No.: US 6,276,903 B1
(45) Date of Patent: Aug. 21, 2001

(54) LIQUID-GAS EJECTOR

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/402,018

(22) PCT Filed: Jan. 26, 1999

(86) PCT No.: PCT/IB99/00135

§ 371 Date: Sep. 27, 1999

§ 102(e) Date: Sep. 27, 1999

(87) PCT Pub. No.: WO99/37925

PCT Pub. Date: Jul. 29, 1999

(30) Foreign Application Priority Data

Jan. 27, 1998 (RU) ..... 98101490

(51) Int. Cl.[7] ..... F04B 5/44
(52) U.S. Cl. ..... 417/198; 417/176
(58) Field of Search ..... 417/196, 151, 417/176

(56) References Cited

U.S. PATENT DOCUMENTS 2,378,425 * 6/1945 Murray ..... 417/176
2,582,069 1/1952 Rose .
5,628,623 5/1997 Skaggs .

FOREIGN PATENT DOCUMENTS 1120-115 A * 10/1984 (RU) ..... 417/196
112242 12/1958 (SU) .
1054580 11/1983 (SU) .
1291730 2/1987 (SU) .
1305445 4/1987 (SU) .

OTHER PUBLICATIONS

Sokolov E.Y., "Jet apparatuses" book, 1970, USSR, Moscow, "Energy" Publishing house, p. 229.

* cited by examiner

*Primary Examiner*—Cheryl J. Tyler
(74) *Attorney, Agent, or Firm*—Mark A. Oathout

(57) ABSTRACT

Each of a liquid gas ejector's mixing chambers has a cylindrical inlet section, a convergent intermediate section and a cylindrical outlet section. The ratio of the cross-sectional area of the inlet cylindrical section of the mixing chamber to the cross-sectional area of the outlet cylindrical section of the mixing chamber is from 0.5 to 50.0; the length of the inlet cylindrical section of the mixing chamber, the length of the intermediate convergent section of the mixing chamber and the length of the outlet cylindrical section of the mixing chamber represent respectively from 0.05 to 36 times, from 0.02 to 50 times and from 0.5 to 220 times the diameter of the outlet cylindrical section of the mixing chamber. A liquid-gas ejector having the introduced design and geometrical parameters pertaining to its mixing chambers exhibits an increase in efficiency.

3 Claims, 1 Drawing Sheet

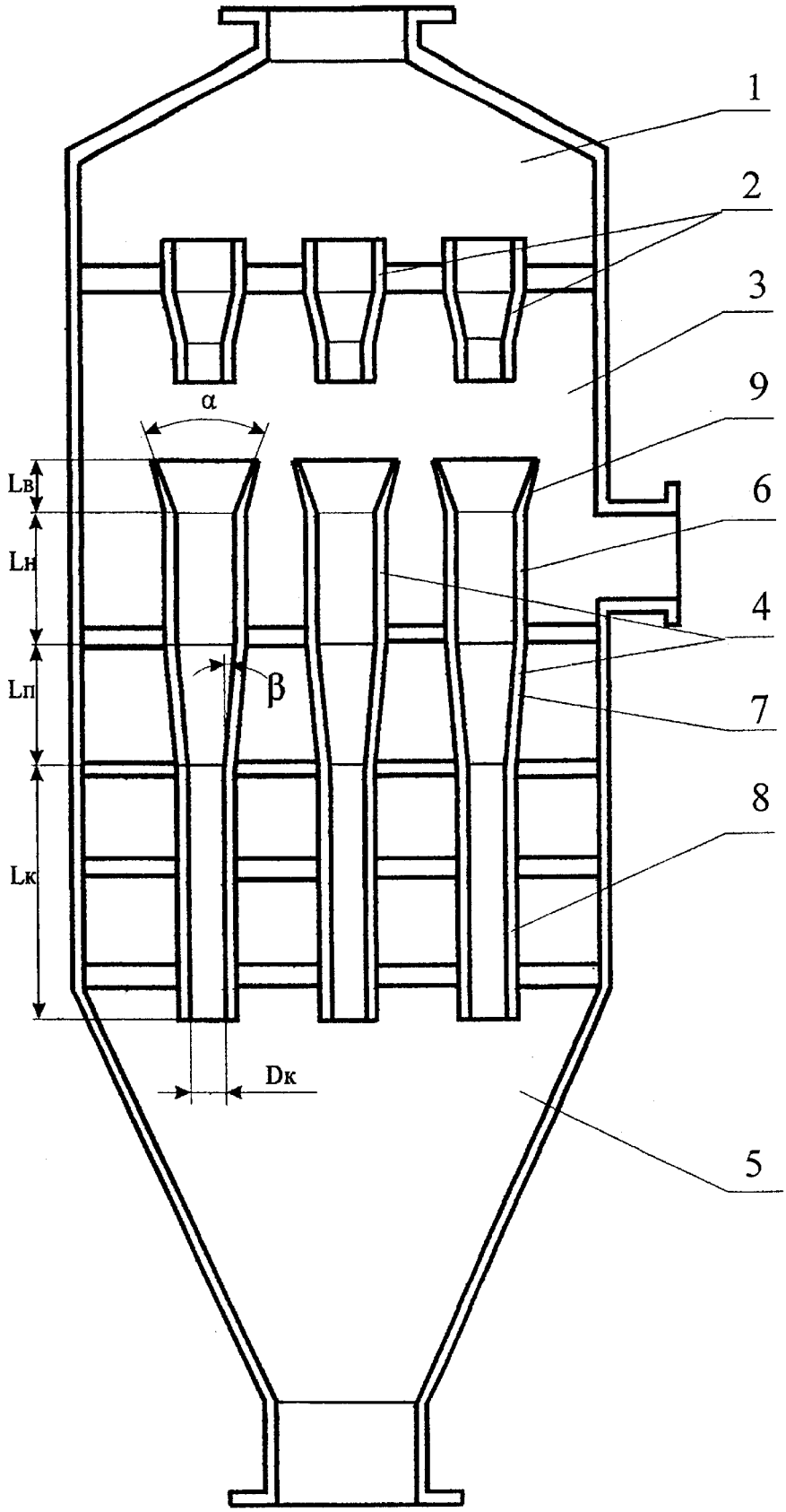
1
2
3
9
6
4
7
8
5
α
β
Lв
Lн
Lп
Lк
Dк

LIQUID-GAS EJECTOR

BACKGROUND OF THE INVENTION

The present invention pertains to the field of jet technology, primarily to jet devices for producing a vacuum and for evacuation of various gaseous and gas-vapor mediums. The invention is applicable in various industrial processes, for example for the vacuum distillation of oil stock in rectifying columns.

A liquid-gas ejector is known, which has a nozzle, a receiving chamber, a mixing chamber and a diffuser (see, for example, SU, Certificate of authorship, 1305445, cl. P 04 F 5/04).

This jet device has a complicated design, that results in high specific consumption of materials. It also has a relatively low efficiency factor.

The closest analogue of the ejector introduced in the present invention is a liquid-gas jet ejector having a distribution chamber with nozzles, a receiving chamber, a mixing chamber and a discharge chamber, wherein each mixing chamber is placed in alignment with its nozzle (see Sokolov E. Y. and Zinger N. M. Jet apparatus, M., Energy 1970, page 228–229).

The given liquid-gas ejector can provide evacuation of gaseous and gas-vapor mediums, however it has a relatively low efficiency factor since the geometry of its elements is nonoptimal and unsuitable for simultaneous evacuation of gas-vapor mediums and generation of a vacuum in the evacuated reservoir.

SUMMARY OF THE INVENTION

The present invention is aimed at increasing the efficiency factor of a liquid-gas ejector through optimization of the geometry of the ejector's elements, specifically the ejector's mixing chambers.

The stated problem is settled as follows: a liquid-gas ejector, which has a distribution chamber with nozzles, a receiving chamber, a discharge chamber and mixing chambers and wherein each mixing chamber is composed of a cylindrical inlet section, a convergent intermediate section and a cylindrical outlet section and is placed in alignment with the corresponding nozzle, has mixing chambers with the following geometrical parameters: the ratio of the cross-sectional area of the inlet cylindrical section of the mixing chamber to the cross-sectional area of the outlet cylindrical section of the mixing chamber is from 0.5 to 50.0; the length of the inlet cylindrical section of the mixing chamber represents from 0.05 to 36 times $D_K$, the length of the intermediate convergent section of the mixing chamber represents from 0.02 to 50 times $D_K$ and the length of the outlet cylindrical section of the mixing chamber represents from 0.5 to 220 times $D_K$, where $D_K$ is the diameter of the outlet cylindrical section of the mixing chamber.

Additionally, each mixing chamber can be furnished with a conical guide duct, converging in the flow direction. The taper angle of the duct is from 1.89° to 45°, the length of the duct represents from 0.02 to 26.0 times $D_K$, where $D_K$ is the diameter of the outlet cylindrical section of the mixing chamber. At the same time, the intermediate convergent section of the mixing chamber can be formed with a conical surface. The angle of inclination of this conical surface from the longitudinal axis of the mixing chamber is from 0.10 to 780.

Experimental research has shown, that the profile of the flow-through canal of the mixing chamber exerts significant influence on the efficiency factor of the liquid-gas ejector. It is known, that a homogeneous gas-liquid mixture can be formed in a mixing chamber, whose length represents from 40 to 50 times the mixing chamber's diameter (for cylindrical mixing chambers), however the stated parameters are effective in a narrow range of the ratio of the cross-sectional area of the mixing chamber to the cross-sectional area of the nozzle's outflow face.

The research has shown, that in the case of evacuation of a gas-vapor medium containing components, which can be condensed during mixing with a liquid ejecting medium, it is not advisable to use a uniform cylindrical mixing chamber. It was determined, that in this case the mixing chamber should be composed of a cylindrical inlet section, a convergent intermediate section and a cylindrical outlet section. For such, an optimal correlation of dimensions of the sections of the described shaped mixing chamber is quite important. It was ascertained that the ratio of the cross-sectional area of the inlet cylindrical section of the mixing chamber to the cross-sectional area of the outlet cylindrical section of the mixing chamber should be from 0.5 to 50.0; the length of the inlet cylindrical section of the mixing chamber, the length of the intermediate convergent section of the mixing chamber and the length of the outlet cylindrical section of the mixing chamber should represent respectively from 0.05 to 36 times, from 0.02 to 50 times and from 0.5 to 220 times the diameter of the outlet cylindrical section of the mixing chamber.

Additionally, in a number of cases, subject to the type of ejecting medium, being fed into the ejector's nozzle, the mixing chamber can be furnished with an inlet guide duct, particularly with a conical guide duct, converging in the flow direction. Subject to the density of the ejecting medium, and further subject to the dispersion ability of the ejecting medium, the taper angle of the inlet guide duct can be from 1.89° to 45° and the length of the duct can represent from 0.02 to 26.0 times the diameter of the outlet cylindrical section of the mixing chamber.

In addition to the above stated correlations between the lengths of the mixing chamber's sections and their cross-sectional areas, the angle of inclination of the conical surface forming the chamber's intermediate convergent section to the longitudinal axis of the mixing chamber can influence the mixing chamber's operation. Subject to the type of ejecting medium, to the nature of the evacuated gaseous medium and to the content of components, which can be condensed in the ejecting medium, in the evacuated medium, the angle of inclination of the conical surface forming the intermediate convergent section to the longitudinal axis of the mixing chamber can be from 0.1° to 78°.

A liquid-gas ejector of the introduced design has an increased efficiency factor.

BRIEF DESCRIPTION OF THE DRAWINGS

A schematic longitudinal section of the described liquid-gas ejector is shown in the drawing.

DETAILED DESCRIPTION OF THE DRAWINGS

The liquid-gas ejector includes a distribution chamber 1 with nozzles 2, a receiving chamber 3, mixing chambers 4 and a discharge chamber 5. Each mixing chamber 4 is installed in alignment with the corresponding nozzle 2. Each mixing chamber is composed of a cylindrical inlet section 6, a convergent intermediate section 7 and a cylindrical outlet section 8. The ratio of the cross-sectional area of the inlet cylindrical section 6 of the mixing chamber 4 to the cross-sectional area of the outlet cylindrical section 8 of the mixing chamber 4 is from 0.5 to 50.0; the length $L_H$ of the inlet cylindrical section 6 of the mixing chamber 4 represents from 0.05 to 36 times $D_K$; the length $L_n$ of the intermediate convergent section 7 of the mixing chamber 4 represents from 0.02 to 50 times $D_K$; and the length $L_K$ of the outlet cylindrical section 8 of the mixing chamber 4 represents from 0.5 to 220 times $D_K$, where $D_K$ is the diameter of the outlet cylindrical section 8 of the mixing chamber 4.

It is preferable to furnish each mixing chamber 4 with an inlet guide duct 9, converging in the flow direction. The taper angle $\alpha$ of the duct is from 1.89° to 45°, and the length $L_B$ of the duct 9 represents from 0.02 to 26.0 times $D_K$, where $D_K$ is the diameter of the outlet cylindrical section 8 of the mixing chamber 4.

Generally, the convergent surface (referenced by $\alpha$) of the inlet guide duct 9 can be formed by a curve. The curve can be convex or concave subject to the desired degree of impact over the flow of the ejected and evacuated mediums at the entrance of the inlet cylindrical section 6 of the mixing chamber 4.

As to the shape of the cross-sections of the nozzles 2 and mixing chambers 4, their cross-sections can be circular, oval, elliptical, as well as they can have another profile, for example a slit-like or cruciate.

It is preferable also if the convergent intermediate section 7 of the mixing chamber 4 constitutes a conical surface (referenced by $\beta$) with the angle of inclination $\beta$ of this conical surface (referenced by $\beta$) to the longitudinal axis of the mixing chamber amounting from 0.1° to 78°.

As to the absolute dimensions of the described liquid-gas ejector, it should be noted that the basic parameter for calculation of the dimensions of the ejector's flow-through channel is the diameter $D_K$ of the outlet cylindrical section 8 of the mixing chamber 4. This diameter can range from 2.5 mm to 360 mm.

The liquid-gas jet apparatus operates as follows: a liquid ejecting medium is fed under pressure into the distribution chamber 1, where it is distributed among the nozzles 2. Jets of the ejecting liquid, flowing from the nozzles 2, entrain an evacuated gaseous or gas-vapor medium from the receiving chamber 3 to the mixing chambers 4. Subject to the ejector's design, the ejecting and evacuated mediums flow into the mixing chambers 4 through the guide ducts 9, or directly through the inlet cylindrical sections 6. As a result of mixing of the ejected and evacuated mediums in the mixing chamber 4 a homogeneous gas-liquid mixture is formed. At the same time, depending on the composition of the evacuated medium, a part of the evacuated medium's components can be condensed in the ejecting liquid. Non-condensable components of the evacuated medium are compressed during mixing with the ejecting liquid due to partial transformation of the ejecting liquid's kinetic energy into potential energy of pressure. The gas-liquid mixture formed in the mixing chambers 4 flows into the discharge chamber 5 and then it is discharged from the ejector.

Industrial Applicability: The invention can be applied in the chemical and petrochemical industries, for example for the vacuum distillation of various substances, as well as in some other industries, where vacuum processes are used.

What is claimed is:

1. A liquid-gas ejector, having a distribution chamber, a plurality of nozzles mounted in the distribution chamber, a receiving chamber adjacent to the nozzles, a plurality of mixing chambers, one each, installed in alignment with each of the nozzles, and a discharge chamber adjacent to the mixing chambers, comprising:

each of the mixing chambers including a cylindrical inlet section, a convergent intermediate section and a cylindrical outlet section;

wherein a ratio of the cross-sectional area of the cylindrical inlet section of each mixing chamber to the cross-sectional area of the cylindrical outlet section of each mixing chamber is in a range from 0.5 to 50.0;

wherein the length of the cylindrical inlet section of each mixing chamber is in a range from 0.05 to 36 times the diameter of the cylindrical outlet section of each mixing chamber, wherein the length of the convergent intermediate section of each mixing chamber is in a range from 0.02 to 50 times the diameter of the cylindrical outlet section of each mixing chamber; and wherein the length of the cylindrical outlet section of each mixing chamber is in a range from 0.5 to 220 times the diameter of the cylindrical outlet section of each mixing chamber.

2. The liquid-gas ejector according to claim 1 wherein each of the mixing chambers further includes an inlet guide duct having a surface converging in the flow direction, wherein the taper angle of the surface converging in the flow direction is in a range from 1.89° to 45°; and wherein the length of the inlet guide duct is in a range from 0.02 to 26.0 times the diameter of the cylindrical outlet section of each mixing chamber.

3. The liquid-gas ejector according to claim 1, wherein the convergent intermediate section of each of the mixing chambers includes a conical surface, wherein the angle of inclination of the conical surface to the longitudinal axis of each mixing chamber is in a range from 0.1° to 78°.

* * * * *